US010422185B2

(12) United States Patent
Speer et al.

(10) Patent No.: US 10,422,185 B2
(45) Date of Patent: Sep. 24, 2019

(54) DUAL CIRCULATION FLUID HAMMER DRILLING SYSTEM

(71) Applicant: Strada Design Limited, St. Helier, Jersey (GB)

(72) Inventors: Ian Speer, Gooseberry Hill (AU); Warren Strange, St. Helier (GB)

(73) Assignee: Strada Design Limited, St. Helier, Jersey (GB)

( * ) Notice: Subject to any disclaimer, the term of this patent is extended or adjusted under 35 U.S.C. 154(b) by 0 days.

(21) Appl. No.: 15/550,921

(22) PCT Filed: Nov. 16, 2015

(86) PCT No.: PCT/AU2015/000693
§ 371 (c)(1),
(2) Date: Aug. 14, 2017

(87) PCT Pub. No.: WO2016/074025
PCT Pub. Date: May 19, 2016

(65) Prior Publication Data

US 2018/0044991 A1 Feb. 15, 2018

(30) Foreign Application Priority Data

Nov. 14, 2014 (AU) ..... 2014904589

(51) Int. Cl.
*E21B 10/38* (2006.01)
*E21B 7/24* (2006.01)
(Continued)

(52) U.S. Cl.
CPC ..... *E21B 7/24* (2013.01); *E21B 1/00* (2013.01); *E21B 3/02* (2013.01); *E21B 10/38* (2013.01);
(Continued)

(58) Field of Classification Search
CPC ..... E21B 7/24; E21B 1/00
(Continued)

(56) References Cited

U.S. PATENT DOCUMENTS

| | | | | |
|---|---|---|---|---|
| 1,868,400 | A | 7/1932 | Stover | |
| 5,427,190 | A | 6/1995 | Mo | |
| 2015/0136492 | A1* | 5/2015 | Speer | E21B 21/12 175/70 |

FOREIGN PATENT DOCUMENTS

| | | | |
|---|---|---|---|
| CN | 102966304 | A | 3/2013 |
| DE | 10005941 | A | 10/2001 |

(Continued)

OTHER PUBLICATIONS

International Preliminary Report on Patentability, completed Dec. 23, 2016, pertaining to PCT/AU2015/000693, filed Nov. 16, 2015.

(Continued)

*Primary Examiner* — Taras P Bemko
(74) *Attorney, Agent, or Firm* — Dinsmore & Shohl, LLP

(57) ABSTRACT

A dual circulation fluid hammer drilling system (10) has a fluid hammer (12) which is coupled to a drill string (14). The system (10) utilizes a first fluid (16) and a second fluid (18). The first fluid (16) is delivered through the drill string (14) to drive or otherwise power the fluid hammer (12). The second fluid (18) is also delivered through the drill string (14) but in isolation of the first fluid (16) so they do not mix within the drill string (14). The second fluid (18) passes through a hammer bit (38) of the hammer drill (12) and is directed to flow out from a bit face (20). Thus when the system (10) is in use the second fluid (18) will flow across the bit face (20). The first fluid (16) also exits the drilling system (10) at the hammer drill (12). However the first fluid (16) exits upstream or up-hole of the bit face (20).

26 Claims, 1 Drawing Sheet

(51) Int. Cl.

| | |
|---|---|
| ***E21B 21/12*** | (2006.01) |
| ***E21B 1/00*** | (2006.01) |
| ***E21B 3/02*** | (2006.01) |
| ***E21B 17/18*** | (2006.01) |
| ***E21B 21/08*** | (2006.01) |
| *E21B 21/00* | (2006.01) |

(52) U.S. Cl.
CPC ..... *E21B 17/18* (2013.01); *E21B 21/08* (2013.01); *E21B 21/12* (2013.01); *E21B 2021/006* (2013.01)

(58) Field of Classification Search
USPC ..... 175/57
See application file for complete search history.

(56) References Cited

FOREIGN PATENT DOCUMENTS

| | | | |
|---|---|---|---|
| WO | 0026576 | A1 | 5/2000 |
| WO | 244508 | A2 | 6/2002 |
| WO | 2011011817 | A1 | 2/2011 |
| WO | 2013106890 | A1 | 7/2013 |

OTHER PUBLICATIONS

Extended Supplementary European Search Report, dated Aug. 7, 2018, pertaining to EP15859310.3.

* cited by examiner

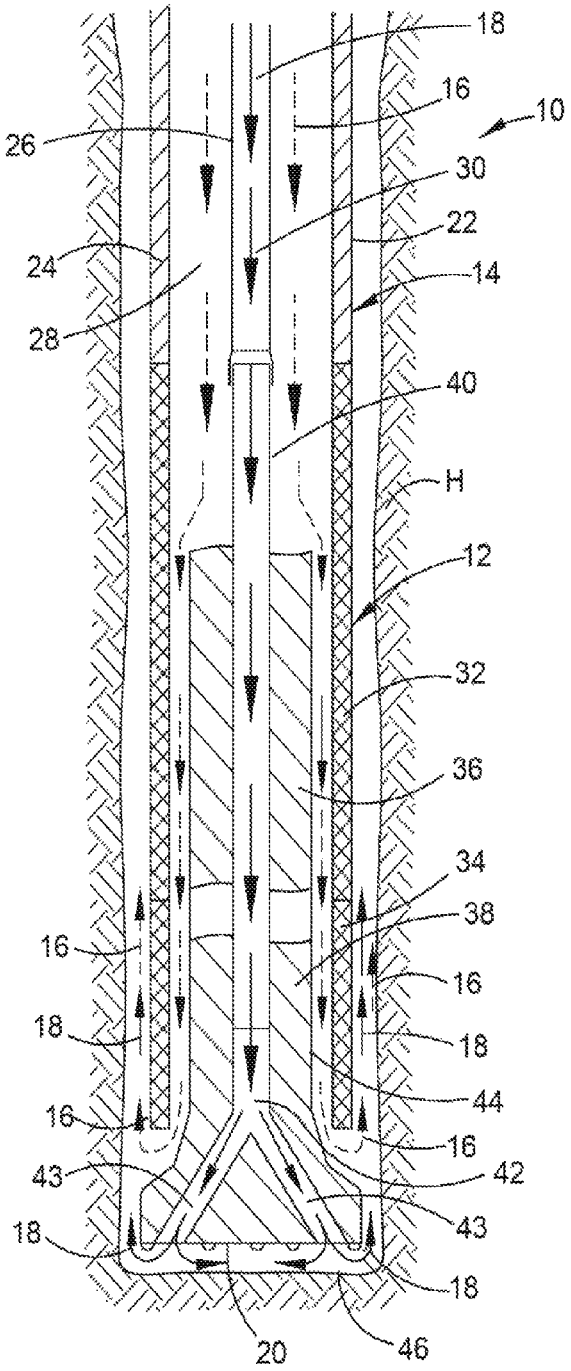
18
16
10
26
30
22
24
14
28
40
H
12
32
36
34
38
16
16
18
18
44
16
16
43
42
43
18
18
20
46

DUAL CIRCULATION FLUID HAMMER DRILLING SYSTEM

TECHNICAL FIELD

A system and method are disclosed for drilling a hole in the ground for example for, but not limited to, oil and gas exploration or production.

BACKGROUND ART

In oil and gas exploration and production it is common to use a down hole motor which is driven by an flowing incompressible fluid to rotate an attached drill bit. The fluid is often, but not necessarily, high specific gravity fluid such as drilling mud. The mud (or other incompressible fluid) can also act to clear cuttings from the hole and provide down hole pressure control. Additionally it is sometimes possible to increase the volumetric flow rate of mud through a down hole motor to kill a well if required.

However there is a limitation in terms of drilling in hard materials particularly with directional (i.e. non-vertical holes). This arises due to the inability to apply sufficient down hole pull-down or weight on bit ("WOB") on the drill bit to fracture rock and progress the drilling at an economic rate.

The limitation of penetration in hard materials can be overcome by the use of a hammer drill. Hammer drills are driven by a fluid. Air is a common driving fluid. However air does not enable control of down hole and ground pressure. Also it is often not possible to provide the air with the required pressure and volume to provide sufficient pressure differential with reference to the prevailing down hole environment to effectively drive the hammer.

Instead of air, water and additives such as drilling mud can used to drive the hammer. This enables higher drilling pressures to be provided to combat high ground pressures. However due to its inherent nature the mud rapidly wears the internal surfaces of the hammer leading to the need for frequent replacement. This involves the very time consuming process of tripping the drill string. Also conventional hammer drills do not enable a sufficient volumetric flow rate to kill a well (i.e. flood the well quickly to control or stop the flow of gas and other dangerous well conditions) in the event of a dangerous over pressure condition.

SUMMARY OF THE DISCLOSURE

In broad terms a drilling system and method are disclosed in which a first fluid is used to operate a down the hole hammer, while a second fluid is used to assist in the drilling process. The fluids are isolated from each other while flowing down the hole. The assistance provided by the second fluid may include but is not limited to any one or a combination of: flushing drill cuttings from the hole; controlling downhole pressure conditions in the hole; flushing cutting and providing lubrication at the face a hammer bit; and killing a well. When drilling in relation to hydrocarbons the control of downhole pressure includes to provide either overbalanced, underbalanced or balanced pressure conditions The drilling system includes a drill string to which the hammer is attached. The drill string is configured to provide first and second flow paths fluidically isolated from each other. This makes it possible to optimise the fluids for their specific purposes. For example the first fluid which is used to operate the drilling tool drill can be provided as a fluid that is optimum for operating the drilling tool in terms of power, speed, efficiency and longevity of the tool. On the other hand the second fluid may be optimised in terms of clearing the hole of drill cuttings, hole stability and providing a desired downhole pressure condition, either by itself or when mixed with the first fluid in the event that the first fluid is into the hole exhausted after operating the tool. The parameters or characteristic that may be selected for the second fluid include but are not limited to: up hole velocity, viscosity and specific gravity.

The first fluid may be denoted as a "power fluid" as this is the fluid that provides power to and drives the down the hole hammer drill. It is the power fluid that flows through a porting arrangement of the hammer drill to reciprocate a piston which cyclically impacts the drill bit of the hammer drill. In various embodiments the first fluid may comprise a liquid or a gas or combination thereof, such as but is not limited to: water, oil, air, nitrogen gas, or mixtures thereof.

The second fluid has multiple functions which can be perform either simultaneously or separately in various circumstances. For example the second fluid may function as a flushing fluid to flush cuttings from the hole and in particular from a bit face of the drill bit. The second fluid may also be used to control downhole pressure. For this reason the second fluid may also be denoted as, or as functioning as, a "flushing fluid" or a "control fluid". The second fluid in most instances is a liquid such as but not limited to: water, drilling mud or cement. In the event that water is used as the second fluid it is not of great significance to the operational life of the hammer if the water carries with it significant fractions of particulate material.

In one aspect there is provided a dual circulation fluid hammer drilling system comprising:

- a drill string configured to separately convey a first fluid and a second fluid down a hole, the drill string having an up hole end and an opposite down hole end; and
- a hammer drill having a drill bit with a bit face, the hammer drill coupled to the down hole end of the drill string wherein the first fluid provides power to drive the hammer drill and the second fluid is directed to flow across the bit face when the bit face is in contact with a toe of a hole bring drilled.

In one embodiment the second fluid is directed to flow through the drill bit.

In one embodiment the drill bit is provided with a passage which opens onto the bit face and the second fluid is directed to flow through the passage.

In one embodiment the first fluid is directed to flow across an outer surface of the drill bit into a hole being drilled by the drilling system.

In one embodiment a fraction of the first fluid is directed to flow through the passage in the drill bit.

In one embodiment the first fluid flows from the hammer dill into the hole as a substantially annular flow which surrounds the second fluid when the flows across the bit face.

In one embodiment the drill string comprises a first fluid flow path for conveying the first fluid and a second fluid flow path for directing the second fluid wherein the second fluid flow path runs along a central axis of the drill string.

In one embodiment the first fluid flow path is an annular path.

In one embodiment the drill string comprises one or more dual wall pipes, each dual wall pipe having an outer wall and an inner wall, the outer wall surrounding the inner wall, wherein an annular space is formed by and between the inner wall and the outer wall the annular space constituting a flow path for one of the first and second fluids, and the inner wall forming a central flow path for the other of the first and second fluids In one embodiment the dual circulation fluid hammer comprises a rotation head arranged to couple to the up hole end of the drill string, the rotation head arranged to provide torque to the hammer drill.

In a second aspect there is disclosed a method of drilling a hole in the ground using a fluid operated hammer drill having a drill bit with a bit face, the method comprising:

delivering separate flows of a first fluid and a second fluid through a drill string;

driving a fluid operated hammer drill coupled at a downhole end of the drill string by the flow of the first fluid through the hammer drill; and, directing the flow of the second liquid to flow through the drill bit and across the bit face when the bit face is in contact with a toe of a hole bring drilled.

In one embodiment the method may comprise enabling the first fluid to flow out of the hammer across an outer surface of the drill bit.

In one embodiment the method may comprise delivering the second fluid thought a central flow path in the drill string.

In one embodiment the method may comprise delivering the first fluid thought an annular flow path in the drill string.

In each embodiment the method comprises adjusting down hole pressure by varying a physical characteristic of one or both of the first fluid and the second fluid.

In one embodiment the method comprises adjusting one or both of the specific gravity and the viscosity of the second fluid.

In one embodiment adjusting down hole pressure comprises dynamically adjusting down hole pressure to provide a desired pressure condition in the hole.

In one embodiment the method comprises dynamically adjusting down hole pressure in a manner to provide an underbalanced pressure condition in the hole.

In one embodiment the method comprises dynamically adjusting down hole pressure in a manner to provide an overbalanced pressure condition in the hole.

In one embodiment the method comprises dynamically adjusting down hole pressure in a manner to provide a balanced pressure condition in the hole.

In one embodiment the method comprises providing the first and second fluids as fluids of different specific gravity.

In one embodiment the method comprises providing the first and second fluids as fluids of different viscosity.

In one embodiment the method comprises providing the first and second fluids at the same pressure.

In a third aspect there is disclosed a dual circulation fluid hammer drilling system comprising:

a drill string arranged to form a first fluid flow path and a second fluid flow path that are fluidically isolated from each other, the drill string having an up hole end and an opposite down hole end;

a hammer drill coupled to the down hole end of the drill string, the hammer drill having a drill bit and bit face, the hammer drill being in fluid communication with the first fluid flow path wherein the hammer drill is operated by a first fluid flowing through the first fluid flow path; and, wherein the second fluid flow path is arranged to flow through the drill bit and across the bit face when the bit face is in contact with a toe of a hole bring drilled.

In an fourth aspect there is disclosed a method of drilling an exploration or production hole for a hydrocarbon, the method comprising:

coupling a fluid operated hammer drill having a drill bit and bit face to a downhole end of a drill string;

using a machine coupled to an up hole end of the drill string to impart torque to the hammer drill and provide pull down or pull up to the hammer drill;

delivering a first fluid through the drill string to operate the hammer drill;

delivering a second fluid through the drill string in isolation of the first fluid, wherein the second fluid flows through the drill bit and across the bit face when the bit face is in contact with a toe of a hole bring drilled.

In one embodiment the method also comprises modifying one or more characteristics of the second fluid to control down hole pressure conditions independent of operating the hammer drill.

BRIEF DESCRIPTION OF THE DRAWINGS

Notwithstanding any other forms which may fall within the scope of the system and method as set forth in the Summary, a specific embodiment will now be described by way of example only with reference to the accompanying drawing in which:

FIG. 1 is a schematic representation of an embodiment of the dual circulation fluid hammer drilling system.

DETAILED DESCRIPTION OF SPECIFIC EMBODIMENT

FIG. 1 is a schematic representation of an embodiment of the disclosed dual circulation fluid hammer drilling system 10 (hereinafter referred to in general as "system 10"). The system 10 comprises a fluid hammer 12 which is coupled to a drill string 14. The system 10 utilises two fluids, the first fluid 16 depicted by dashed lines with terminating arrowheads depicting direction of flow, and a second fluid 18 depicted by solid lines with terminating arrowheads depicting direction of flow. The first fluid 16 is delivered through the drill string 14 to drive or otherwise power the fluid hammer 12. The second fluid 18 is also delivered through the drill string 14 but in isolation of the first fluid 16 so they do not mix within the drill string 14. The second fluid 18 passes through the hammer drill 12 and is directed to flow out from a bit face 20 of a hammer bit of the hammer drill 12. Thus when the system 10 is in use the second fluid 18 will flow across the bit face 20. The first fluid 16 also exits the drilling system 10 at the hammer drill 12. However the first fluid 16 exits upstream or up-hole of the bit face 20.

Due to the flow of the two separate fluids 16 and 18, the fluid hammer 12 is sometimes referred to in this specification as a dual circulation fluid hammer or a DC fluid hammer.

By virtue of the system 10 utilising two separate fluids 16 and 18 it is possible to meet otherwise conflicting drilling requirements. These include, but are not limited to the following. The first fluid 16 can be selected as the best fluid for operating the hammer 12 in terms of efficiency and longevity of the hammer drill 12. Maintaining the hammer drill 12 in good working condition is critical in terms of minimising down time that may otherwise be required to change the hammer drill 12. The fluid 16 need not have any properties that are of significance or relevance to controlling downhole pressure conditions. This enables the selection of the fluid 16, as well as its pressure and flow rate/volume to be based purely on the required operating characteristics and performance of the hammer drill 12 itself.

Therefore the fluid 16 can be a gas or a liquid (i.e. compressible or incompressible fluid) such as air if the hole depths and pressure differentials are such that air can be delivered at sufficient pressure and flow rate/volume to operate the hammer drill 12. Alternately the first fluid can be a liquid (i.e. incompressible fluid) such as but not limited to water. The term "water" in the context of the first fluid 16 in operating or powering the hammer drill 12 is intended to be reference to clean water or relatively clean water with an acceptably small fraction of small particulate matter. For example the water can have a purity of 5μ. This is to be distinguished from dirty water or muds which essentially are water mixed with significant fractions of relatively large particulate matter. It is indeed known to use mud to drive fluid hammers. However such hammers have a short service life as the mud has an abrasive effect on the internal workings of the hammer and in particular the porting surfaces. This leads to rapid degradation of performance and the necessity to change the hammer 12 on a regular basis.

The second fluid 18 which flows in isolation to the first fluid 16 can be chosen to have characteristics to control downhole conditions, provide lubrication to the bit face 20 and flush cuttings from the hole H. This fluid may be but is not limited to gases, water, dirty water, drilling mud, drilling additives, lubricants and a combination of two or more of these.

Although the first fluid 16 is not crucial in terms of controlling downhole pressure conditions it's density and viscosity can be taken into account when selecting the second fluid 18 so that the mixture of the fluids 16 and 18 provide a desired downhole pressure condition. Thus, one can select or modify the characteristics of the second fluid 18 to provide the desired downhole conditions taking into account, but without requiring any change of, the first fluid 16.

Looking at the system 10 in more detail, the drill string 14 is constructed of a plurality of dual wall pipes 22 (only one shown) connected end-to-end. Each dual wall pipe 22 has an outer wall 24 and an inner wall 26. An annular flow path 28 is defined between the wall 24 and 26. In this embodiment the first fluid 16 flows through the annular flow path 28. The second wall 26 is located and held within the outer wall 24 and defines a flow path 30 for the second fluid 18.

The hammer drill 12 is of generally regular construction having an outer tube 32 with a drive sub 34 connected at a lower end. A piston 36, drill bit 38 and inner tube 40 constitute the significant components of the hammer drill 12. The piston 36 reciprocates on the inner tube 40. The inner tube 40 also extends into a passage 42 of the drill bit 38. The passage 42 has a central upstream portion which in a down hole portion splits into several branches 43. The branches 43 open onto the bit face 20.

The drive sub 34 enables torque imparted to the drill string 22 to be transferred to the drill bit 38. A locking ring (not shown) may also be associated with the drive sub 34 and the bit 38 to retain the bit 38 from falling from an end of the hammer drill 12.

In operation the first fluid 16 flows through the annular path 28 and through the hammer drill 12 porting arrangement (not shown) formed between the piston 36 and an inside surface of the outer tube 32. As the fluid 16 flows through the porting arrangement it causes reciprocation of the piston 36. The piston therefore slides up and down on the inner tube 40 cyclically striking the hammer bit 38. The fluid 16 flows out of the hammer drill 12 and across an outer surface 44 of the hammer bit 38 from the end of the drive sub 34.

The second fluid 18 flows through the inner tube 26 along the flow path 30 and into the inner tube 40. As the inner tube 40 extends into the passage 42 in the normal operation of the hammer drill 12 including during blow down, the fluid 18 is directed to flow across the bit face 20. This is by virtue of the channel 42 opening onto the bit face 20. Thus the fluid 18 exits the hammer drill 12 at a location between the bit face 20 and a toe 46 of the hole H being drilled. The fluid 18 thereafter flows upwardly together with the fluid 16 to the surface (not shown).

Torque can be imparted to the hammer drill 12 and in particular the drill bit 38 by a machine coupled to an up hole end of the drill string 14. This machine may for example be a drill head on a drill tower or mast; or a rotary table. The system 10 may be used on either land or offshore rigs.

In the event that dangerous conditions are detected it is possible to provide second fluid 18 at sufficient volume and flow rate to kill the well. This arises due to the manner in which the second fluid 18 is delivered which provides for a substantially greater volume of liquid than with a traditional fluid hammer which utilises a single fluid only flowing along the path depicted by the first fluid arrows 16.

As will be apparent from the above the system 10 enables a method of drilling a hole in the ground using a fluid operated hammer drill 12 having a drill bit 38 with a bit face 20, in which separate flows of a first fluid 16 and a second fluid 18 are delivered thought a through a drill string 14. The fluids 16, 18 may be pumped into an up hole end of the drill string using a dual circulation fluid inlet swivel. In this method the first fluid flows to and powers a hammer drill 12 coupled at a downhole end of the drill string 14. When the hammer drill 12 is powered the piston 36 is reciprocated to cyclically impact the hammer bit 38. This impact is transmitted by the bit face 20 to the toe 46 of the hole H.

The method also includes directing the second liquid 18 to flow through the hammer drill 12 and across the bit face 20. The second fluid subsequently flows up the hole flushing cuttings form the hole. The first fluid exits the hammer 12 from the end of the drive sub 34 upstream of the bit face 20. Thus the first fluid 16 flows from the hammer dill 12 into the hole H as a substantially annular flow which surrounds the second fluid 18 as it flows across the bit face 20. The two fluids 16 and 8 are separate from each other when flowing down the hole H but mix when travelling up the hole on the outside of the drill string 14.

The above described embodiment of the system 10 and associated drilling method are particularly well suited to oil and gas operations in hard ground formations. In particular embodiments of the system and method enable the use of down the hole drilling tools in the form of down the hole hammers which are very well suited to drilling in hard materials although do not find favour when drilling for oil/gas due to the trade-off between longevity of the drilling tool and the ability to control down hole pressure and maintain hole stability. For example to drill with a marginal under pressure, when using a regular DTH hammer, it may be required to operate the hammer with a fluid of a relatively high specific gravity. This will entail using a mud or slurry to drive the hammer. However by its very nature the mud or slurry will contain particles that abrade and wear the hammer. As a result it becomes necessary to trip the drill string more regularly in order to replace the worn hammer. When a hole is several kilometers deep, the tripping of the drill string may take up to or exceed 24 hours. However if a working fluid of lower specific gravity is used then the ability to provide a specific pressure condition may be lost. Embodiments of the system and method enable separate provision and control of the parameters and characteristics of the working and flushing fluids thereby enabling maximum efficiency and longevity of the down hole tool while also providing control over down hole pressure and hole stability.

The hammer drill 12 may be in the physical form similar to a reverse circulation drill. But it is important to note that the presently disclosed system and method the hammer drill 12 is not, and is not operated as, a reverse circulation hammer drill. In a reverse circulation hammer drill a single fluid is used to drive the hammer drill. The fluid operates the piston of the hammer drill and exits between the drive sub and the head of the drill bit. The fluid then flows back up a passage in the drill bit and the drill string carrying drill cuttings to the surface.

Embodiments of the presently disclosed system 10 and method operate on the completely opposite principle of delivering a second (control) fluid which is totally independent of the first (power) fluid in a downhole direction through the hammer drill and associated drill bit. Both the first fluid (which operates the hammer drill) and second fluid flow to the surface through the annulus between the hole and the outside surface of the drill string.

Embodiments of the presently disclosed system 10 and method use two separate fluid flows all the way to the bottom of the drill string 14 and thus the well. Consequently the control fluid 18 is mixed with the power fluid 16 exhaust at the bit face or at the bottom of the well. This allows for well control with maximum effect and safety and for the mixing of the both fluids at the bit face.

The purpose of the control fluid 18 is solely for well control and drill cutting transport. The only purpose of the power fluid 16 is to operate the fluid hammer 12. The ratio between the power fluid 18 and the control fluid 16 may be between 10/90 and 30/70. That is 10% power fluid 16 and 90% control fluid 18. This means for example during the drilling of a 8.5 inch well using 5.5 inch drill pipe, an embodiment of the disclosed the fluid hammer 12 will use 10% to 30% of the total well volume as a power fluid 16.

Looked at in terms of fluid volumes and pressures, say for example the total volume of fluid required to drill and lift drill cuttings is 1,000 liters per minute pumped at a pressure of 5,000 psi. The fluid hammer 12 will use 100 to 300 liters per minute of that total volume. The control fluid will be pumped at around 4,000 psi and the flow rate will be 900 to 700 liters per minute.

Thus embodiments of the disclosed the fluid hammer 12 are very efficient in comparison to say a normally operated water hammer. In comparable downhole environment and depth, a normally operated water hammer would typically use over 1,000 liters per minute and up to 2,000 liters per minute. This is substantially more than the 100-300 liters per minute of embodiments of the disclosed system and method.

The very nature and design of prior art single pipe water hammers restricts the depth that the hammers can drill and causes high levels of wear. As embodiments of the disclosed fluid hammer 12 and associated method use much less fluid volume to operate, and utilise a second/control fluid flow to cater for the transport of cuttings and for well control, the disclosed fluid hammer can drill substantially deeper than the standard water hammers. Additionally and the disclosed dual circulation fluid hammer 12 is able to drill for much longer periods between service or replacement. There is no restriction to the control fluid 18 as it does not have to pass through the restrictions inside of a water hammer which give rise to the reciprocation of the piston 36. Also and significantly the mud and other additives that wear out the other single pipe water hammers do not have to pass through DC fluid hammer 12. Again, this adds to the extended life of the disclosed DC fluid hammer 12 in comparison to the single pipe/single fluid conventional water hammers.

Whilst a specific embodiment of the system and method has been described, it should be appreciated that the system and method may be embodied in other forms. For example the fluid 16 may flow though the central path 30 and the second fluid can flow through the annular path 28 however this will require cross over sub to channel the porting region of the hammer 12 to drive the piston 36, and to channel the second fluid to flow through the passage 42.

In the claims which follow, and in the preceding description, except where the context requires otherwise due to express language or necessary implication, the word "comprise" and variations such as "comprises" or "comprising" are used in an inclusive sense, i.e. to specify the presences of the stated feature but not to preclude the presence or addition of further features in various embodiments of the system and method as disclosed herein.

The invention claimed is:

1. A dual circulation fluid hammer drilling system for drilling a hole in the ground comprising:

a drill string configured to separately convey a first fluid and a second fluid down a hole, the drill string having an up hole end and an opposite down hole end; and a hammer drill having, a drive sub and a drill bit with a bit face, the hammer drill coupled to the down hole end of the drill string;

wherein the first fluid provides power to drive the hammer drill and flows between an outer surface of the hammer bit and an inner surface of the drive sub, leaving the hammer from a downhole end of the drive sub; and the second fluid is directed to flow across the bit face when the bit face is in contact with a toe of a hole being drilled; both the first and second fluids being directed to flow back up the hole being drilled through a single annulus formed between an inside surface of the hole and an outside surface of the drill string.

2. The system according to claim 1 wherein the second fluid is directed to flow through the drill bit.

3. The system according to claim 1 wherein the drill bit is provided with a passage which opens onto the bit face and the second fluid is directed to flow through the passage.

4. The system according to claim 1 wherein the first fluid is directed to flow across an outer surface of the drill bit into a hole being drilled by the drilling system.

5. The system according to claim 1 wherein the first fluid flows from the hammer dill into the hole as a substantially annular flow which surrounds the second fluid when the flows across the bit face.

6. The system according to claim 1 wherein the drill string comprises a first fluid flow path for conveying the first fluid and a second fluid flow path for directing the second fluid wherein the second fluid flow path runs along a central axis of the drill string.

7. The system according to claim 6 wherein the first fluid flow path is an annular path.

8. The system according to claim 1 wherein the drill string comprises:

one or more dual wall pipes, each dual wall pipe having an outer wall and an inner wall, the outer wall surrounding the inner wall, wherein an annular space is formed by and between the inner wall and the outer wall the annular space constituting a flow path for one of the first and second fluids, and the inner wall forming a central flow path for the other of the first and second fluids.

9. The system according to claim 1 comprising a mechanism arranged to couple with an up hole end of the drill string and impart torque to the drill string.

10. The system according to claim 1 wherein hammer drill comprises an outer tube coupled between the drill string and the drive sub and a piston slidable with the outer tube, wherein the hammer drill is further arranged so that the first fluid flows between an outside of the piston and an inside surface of the outer tube prior to flow out from the drive sub.

11. A method of drilling a hole in the ground using a fluid operated hammer drill having a drill bit with a bit face, the method comprising:

delivering separate flows of a first fluid and a second fluid through a drill string;

driving the fluid operated hammer drill coupled at a downhole end of the drill string by the flow of the first fluid through the hammer drill;

flowing the first fluid out of the hammer drill from between an outside surface of the drill bit and a drive sub of the hammer drill wherein the first fluid leaves the hammer drill from a downhole end of the drive sub;

directing the flow of the second liquid to flow through the drill bit and across the bit face when the bit face is in contact with a toe of a hole being drilled; and forming a single annular fluid return path back up the hole between the drill and an string inner surface of the hole while drilling the hole; and directing both the first and second fluids to flow back up the hole being drilled through the single annular fluid return path.

12. The method according to claim 11 comprising delivering the first fluid through an annular flow path in the drill string.

13. The method according to claim 11 comprising delivering the second fluid through a flow path surrounded by the annular flow path.

14. The method according to claim 11 comprising adjusting down hole pressure by varying a physical characteristic of one or both of the first fluid and the second fluid.

15. The method according to claim 11 comprising adjusting one or both of the specific gravity and the viscosity of the second fluid.

16. The method according to claim 11 comprising dynamically adjusting down hole pressure to provide a desired pressure condition in the hole.

17. The method according to claim 16 wherein the desired pressure condition is one of: an underbalance condition; an over balanced condition; and a balanced condition.

18. The method according to claim 11 comprising providing the first and second fluids as fluids of different specific gravity.

19. The method according to claim 11 comprising providing the first and second fluids as fluids of different viscosity.

20. The method according to claim 11 comprising providing the first and second fluids at the same pressure.

21. The method according to claim 11 comprising modifying one or more characteristics of the second fluid to control down hole pressure conditions independent of operating the hammer drill.

22. The method according to claim 11 wherein delivering a first fluid comprising delivering a first liquid as the first fluid.

23. The method according to claim 11 wherein delivering a second fluid comprising delivering a second liquid as the second fluid.

24. The method according to claim 22 wherein delivering the first liquid comprises delivering water.

25. The method according to claim 23 wherein delivering the second liquid comprises delivering the second liquid as one, or a mixture of one or more, of the following liquids: water, drilling mud or cement.

26. The method according to claim 11 wherein the first fluid and the second fluid are delivered in a ratio of between about 10/90 to 30/70.

* * * * *